US006405798B1

(12) United States Patent
Barrett et al.

(10) Patent No.: US 6,405,798 B1
(45) **Date of Patent: *Jun. 18, 2002**

(54) DOWNHOLE TOOL AND METHOD

(75) Inventors: Michael P. Barrett, Histon; Stuart I. Jardine, Cambridge; Michael C. Sheppard, Castle Camps, all of (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/101,453

(22) PCT Filed: Jul. 11, 1997

(86) PCT No.: PCT/GB97/01887

§ 371 (c)(1),
(2), (4) Date: Aug. 19, 1998

(87) PCT Pub. No.: WO98/02634

PCT Pub. Date: Jan. 22, 1998

(30) Foreign Application Priority Data

Jul. 13, 1996 (GB) ..... 9614761

(51) Int. Cl.[7] ..... E21B 44/00

(52) U.S. Cl. ..... 166/250.01; 166/254.4; 166/53; 166/66.7

(58) Field of Search ..... 166/250.01, 254.2, 166/55, 55.7, 55.8, 53, 65.1, 66.7, 104, 177.2; 324/76.11; 175/92, 93, 94, 104, 106

(56) References Cited

U.S. PATENT DOCUMENTS

| | | | | |
|---|---|---|---|---|
| 3,225,843 A | | 12/1965 | Ortloff et al. | |
| 3,937,278 A | | 2/1976 | Sheshtawy | 166/63 |
| 4,085,808 A | | 4/1978 | Kling | 175/94 |
| 4,192,380 A | | 3/1980 | Smith | 166/250 |
| 4,378,051 A | | 3/1983 | Cholet et al. | 166/383 |
| 4,509,593 A | * | 4/1985 | Traver et al. | 166/63 |
| 4,565,487 A | | 1/1986 | Kroczynski | 414/730 |
| 4,624,306 A | * | 11/1986 | Traver et al. | 166/53 |
| 4,630,243 A | * | 12/1986 | MacLeod | 367/82 |
| 4,648,454 A | | 3/1987 | Yarnell | 166/297 |

(List continued on next page.)

FOREIGN PATENT DOCUMENTS

| | | |
|---|---|---|
| BR | P1 9706796-2 A | 9/1997 |
| EP | 177 112 A2 | 4/1985 |
| EP | 206 706 A2 | 6/1986 |
| EP | 367 633 A2 | 11/1989 |
| EP | 559 565 A1 | 3/1993 |
| WO | WO 92/18746 | 4/1992 |
| WO | WO 98/02634 | 7/1997 |
| WO | WO 98/12418 | 9/1997 |

OTHER PUBLICATIONS

Euro Robotics & Intell Sys Conf, (1994), pp. 1156–1161, D. S. Cooke et al., "Pirov–Pipe Insertion Remotely Operated Vehicle for Inspecting Nuclear Reactor Internals".

(List continued on next page.)

*Primary Examiner*—Frank S. Tsay
(74) *Attorney, Agent, or Firm*—William L. Wang; William B. Batzer

(57) ABSTRACT

A downhole tool and apparatus is described for logging and/or remedial operations in a wellbore in a hydrocarbon reservoir. The tool comprises an autonomous unit (1) for measuring downhole conditions, preferably flow conditions. The autonomous unit comprises locomotion means (12) for providing a motion along said wellbore; means (14) for detecting said downhole conditions; and logic means (113) for controlling said unit, said logic means being capable of making decisions based on at least two input parameters. It can be separately attached to a wireline unit (22) connected to the surface or launched from the surface. The connection system (31, 32) between both units can be repeatedly operated under down hole conditions and preferably includes an active component for closing and/or breaking the connection.

39 Claims, 7 Drawing Sheets

U.S. PATENT DOCUMENTS

| | | | | | |
|---|---|---|---|---|---|
| 4,676,310 | A | | 6/1987 | Scherbatskoy et al. | 166/65.1 |
| 4,805,951 | A | | 2/1989 | Andersson et al. | 294/116 |
| 4,860,581 | A | | 8/1989 | Zimmerman et al. | 73/155 |
| 4,862,808 | A | | 9/1989 | Hedgcoxe et al. | 104/138 |
| 4,914,944 | A | * | 4/1990 | Herron et al. | 73/152 |
| 5,111,401 | A | | 5/1992 | Everett, Jr. et al. | 364/424.02 |
| 5,186,264 | A | | 2/1993 | du Chaffaut | 175/27 |
| 5,203,646 | A | * | 4/1993 | Landsberger et al. | 405/191 |
| 5,210,821 | A | | 5/1993 | Yazaki et al. | 395/83 |
| 5,254,835 | A | | 10/1993 | Dalke et al. | 219/125.11 |
| 5,291,112 | A | | 3/1994 | Karidis et al. | 318/568 |
| 5,293,823 | A | | 3/1994 | Box | 104/138 |
| 5,316,094 | A | | 5/1994 | Pringle | 175/74 |
| 5,318,136 | A | | 6/1994 | Rowsell et al. | 175/24 |
| 5,350,033 | A | | 9/1994 | Kraft | 180/167 |
| 5,373,898 | A | | 12/1994 | Pringle | 166/72 |
| 5,390,748 | A | | 2/1995 | Goldman | 175/24 |
| 5,392,715 | A | * | 2/1995 | Pelrine | 104/138.2 |
| 5,394,951 | A | | 3/1995 | Pringle et al. | 175/45 |
| 5,417,295 | A | | 5/1995 | Rao et al. | 175/40 |
| 5,452,761 | A | * | 9/1995 | Beard et al. | 166/250 |
| 5,706,896 | A | * | 1/1998 | Tubel et al. | 166/313 |
| 5,947,213 | A | * | 9/1999 | Angle et al. | 175/24 |
| 5,974,348 | A | | 10/1999 | Rocks | 701/28 |
| 6,009,359 | A | | 12/1999 | El-Hakim et al. | 701/28 |
| 6,026,911 | A | | 2/2000 | Angle et al. | 175/24 |
| 6,031,371 | A | * | 2/2000 | Smart | 166/55.7 X |
| 6,041,860 | A | | 3/2000 | Nazzal et al. | 166/250.01 |
| 6,089,512 | A | | 7/2000 | Ansorge et al. | 246/194 |
| 6,112,809 | A | | 9/2000 | Angle | 166/66 |

OTHER PUBLICATIONS

Automation & Robotics in Construction XI, (1994), pp. 441–447, Y. Kimura et al., "Development of a Fully Automatic Robotic System for Small Diameter Tunnel Construction: Development of the ACE MOLE 1200–M2 Construction Method".

Proc of the 1993 IEEE/RSJ Int'l Conf on Intell Robots and Sys, (1993), vol. 1, pp. 509–516, S. Fujiwara et al., "An Articulated Multi–Vehicle Robot for Inspection and Testing of Pipelined Interiors".

Offshore, Dec. 1999, pp. 101–102, W. Furlow, "Wireless Tractor Enters Flowing Well to Conduct Repairs".

IFAC Intelligent Autonomous Vehicles, (1995), pp. 295–300, H. Makela et al., "Navigation System for LHD Machines".

* cited by examiner

DOWNHOLE TOOL AND METHOD

The present invention relates to downhole tools and methods for measuring formation properties and/or inspecting or manipulating the inner wall or casing of a wellbore. In particular, it relates to such tools and methods for use in horizontal or high-angle wells.

BACKGROUND OF THE INVENTION

With the emergence of an increasing number of non-vertically drilled wells for the exploration and recovery of hydrocarbon reservoirs, the industry today experiences a demand for logging tools suitable for deployment in such wells.

The conventional wireline technology is well established throughout the industry. The basic elements of down hole or logging tools are described in numerous documents. In the U.S. Pat No. 4,860,581, for example, there is described a down hole tool of modular construction which can be lowered into the wellbore by a wire line. The various modules of the tool provide means for measuring formation properties such as electrical resistivity, density, porosity, permeability, sonic velocities, density, gamma ray absorption, formation strength and various other characteristic properties. Other modules of the tool provide means for determining the flow characteristics in the well bore. Further modules include electrical and hydraulical power supplies and motors to control and actuate the sensors and probe assemblies. Generally, control signals, measurement data, and electrical power are transferred to and from the logging tool via the wireline. This and other logging tools are well known in the industry.

Though the established wireline technology is highly successful and cost-effective when applied to vertical bore holes, it fails for obvious reasons when applied to horizontal wells.

In a known approach to overcome this problem, the logging tool is mounted to the lowermost part of a drill pipe or coiled tubing string and thus carried to the desired location within the well.

This method however relies on extensive equipment which has to be deployed and erected close to the bore hole in a very time-consuming effort. Therefore the industry is very reluctant in using this method, which established itself mainly due to a lack of alternatives.

In a further attempt to overcome these problems, it has been suggested to combine the logging tool with an apparatus for pulling the wireline cable through inclined or horizontal sections of the wellbore. A short description of these solutions can be found in U.S. Pat. No. 4,676,310, which itself relates to a cableless variant of a logging device.

The cableless device of the U.S. Pat. No. 4,676,310 comprises a sensor unit, a battery, and an electronic controller to store measured data in an internal memory. Its locomotion unit consists of means to create a differential pressure in the fluid across the device using a piston-like movement. However,,its limited autonomy under down hole conditions is perceived as a major disadvantage of this device. Further restricting is the fact that the propulsion method employed requires a sealing contact with the surrounding wellbore. Such contact is difficult to achieve, particularly in unconsolidated, open holes.

Though not related to the technical field of the present invention, a variety of autonomous vehicles have been designed for use in oil pipe and sewer inspection. For example, in the European patent application EP-A-177112 and in the Proceeding of the 1993 IEEE/RSJ International Conference on Intelligent Robots and Systems, a robot for the inspection and testing of pipeline interiors is described. The robot is capable of traveling inside pipes with a radius from 520 mm to 800 mm.

In the U.S. Pat. No. 4,860,581, another robot comprising a main body mounted on hydraulically driven skids is described for operation inside pipes and bore holes.

In view of the known logging technology as mentioned above, it is an object of the present invention to provide a down-hole tool and method which is particularly suitable for deviated or horizontal wells.

SUMMARY OF THE INVENTION

The object of the invention is achieved by methods and apparatus-as set forth in the appended claims.

An autonomous unit or robot according to the present invention comprises a support structure, a power supply unit, and a locomotion unit. The support structure is used to mount sensor units, units for remedial operations, or the like. The power supply can be pneumatic or hydraulic based. In a preferred embodiment, however, an electric battery unit, most preferably of a rechargeable type, is used.

The autonomous unit further comprises a logic unit which enables the tool to make autonomous decisions based on measured values of two or more parameters. The logic unit is typically one or a, set of programmable microprocessors connected to sensors and actuators through appropriate interface systems. Compared to known devices, such as those described in U.S. Pat. No. 4,676,310, this unit provides a significantly higher degree of autonomy to the down hole tool. The logic unit can be programmed as a neural network or with fuzzy logic so as to enable a quasi-intelligent behavior under down hole conditions.

As another feature, the improved down hole tool comprises a locomotion unit which requires only a limited area of contact with the wall of the wellbore. The unit is designed such that during motion an essentially annular region is left between the outer hull of the autonomous unit and the wall of the wellbore. This allows well fluid to pass between the wall of the wellbore and the outer hull of tool. The essentially annular region might be off-centered during operation when, for example, the unit moves by sliding at the bottom of a horizontal well. Again compared to the device of U.S. Pat. No. 4,676,310, no sealing contact with the surrounding wall is required. Hence, the improved device can be expected to operate, not only a casing, but as well in an open hole environment.

Preferably, the locomotion unit is wheel or caterpillar based. Other embodiment may include several or a plurality of legs or skids. A more preferred variant of the locomotion unit comprises at least one propeller enabling a U-boat style motion. Alternatively, the locomotion unit may employ a combination of drives based on different techniques.

Among useful sensor units are (1) flow measurement sensors, such as mechanical, electrical, or optical flow meters; (2) sonic or acoustic energy sources and receivers; (3) gamma ray sources and receivers; (4) local resistivity probes; and (5) images collecting devices—e.g., video cameras.

In a preferred embodiment, the robot is equipped with sensing and logging tools to identify the locations of perforations in the well and to perform logging measurements.

In variants of the invention the down hole tool comprises the autonomous unit in combination with a wireline unit which in turn is connected to the surface.

The wireline unit can be mounted on the end of a drill pipe or coiled tubing device. However, in a preferred embodiment, the unit is connected to the surface by a flexible wire line and is lowered into the bore hole by gravity.

Depending on the purpose and design of the autonomous unit, the connection to the wireline unit provides either a solely mechanical connection to lower and lift the tool into or out of the well, or, in a preferred embodiment of the invention, means for communicating energy and/or control and data signals between the wireline unit and the robot. For the latter purpose; the connection has to be preferably repeatedly separable and re-connectable under down hole conditions—that is, under high temperature and immersed in a fluid/gas flow. In a preferred embodiment, the connection system includes an active component for closing and/or breaking the connection.

These and other features of the invention, preferred embodiments and variants thereof, possible applications thereof, and advantages thereof will become appreciated and understood by those skilled in the art from the detailed description and drawings following below.

MODE(S) FOR CARRYING OUT THE INVENTION

Figure 1A:
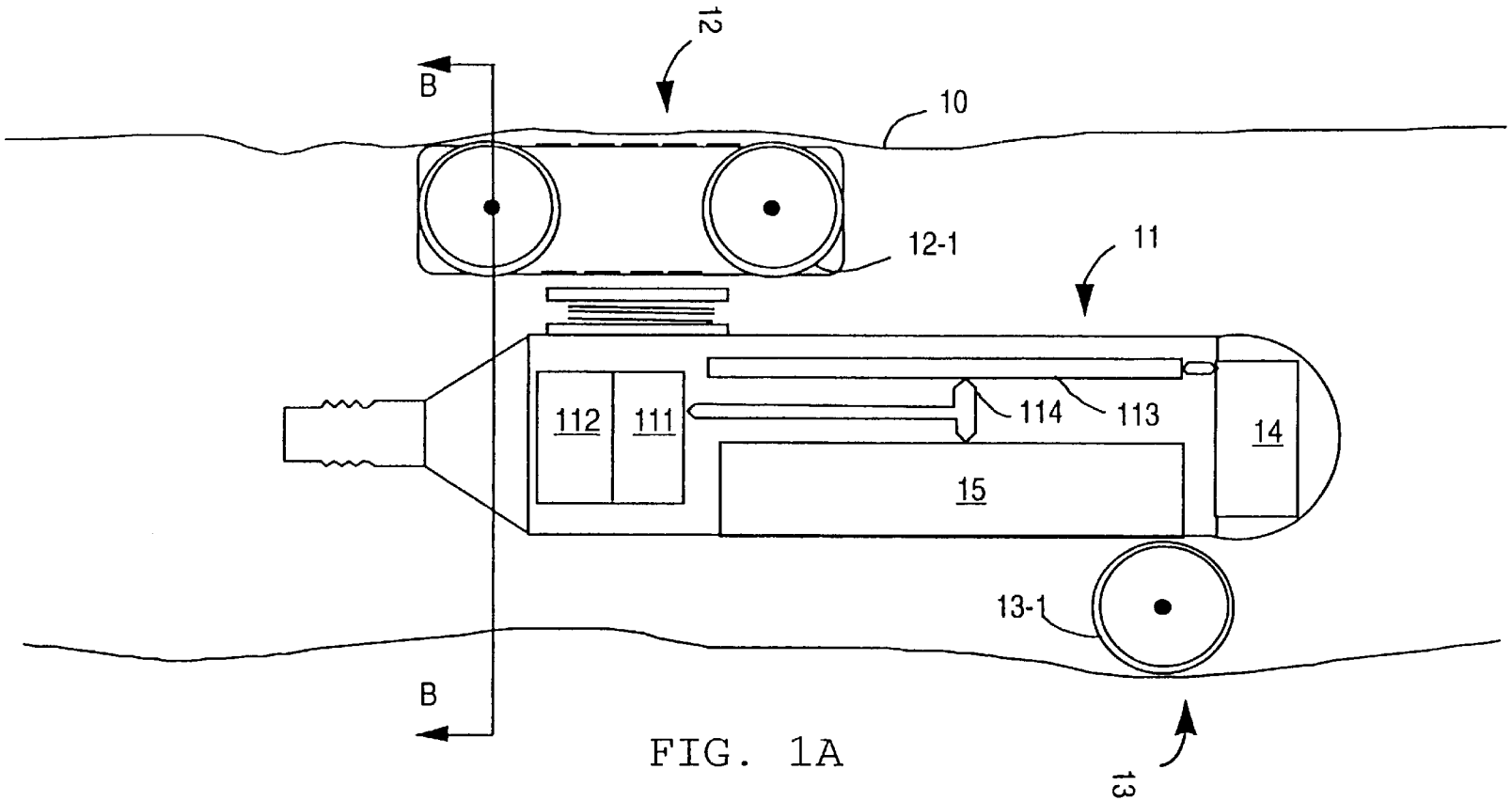
FIGS. 1A, B show (schematic) cross-sections of an autonomous unit of a down hole tool in accordance with the invention.
Figure 1B:
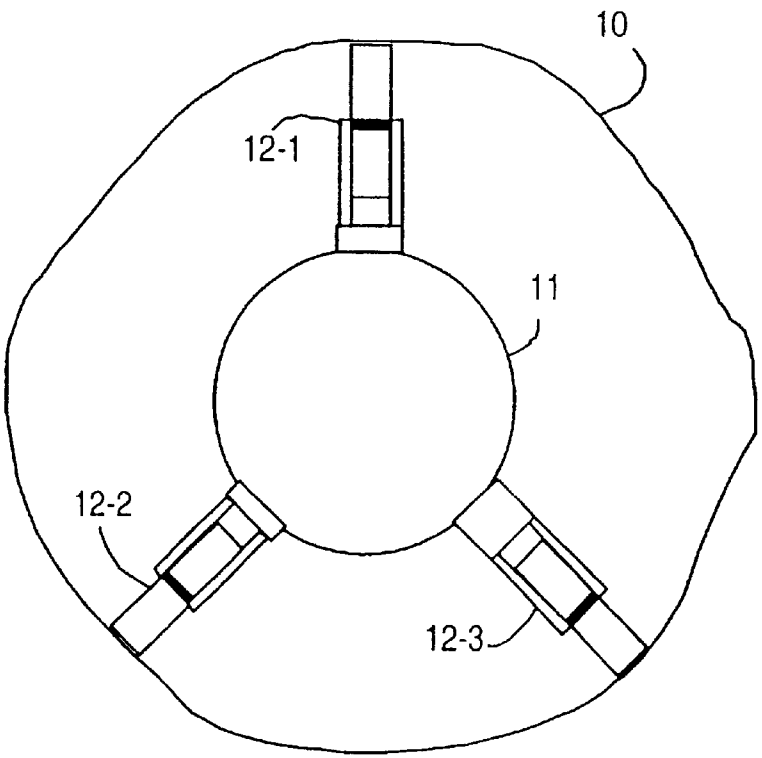

Referring to FIGS. 1A and 1B, an autonomous unit of a down hole tool in accordance with the invention has a main body 11 which includes an electric motor unit 111, a battery unit 112, and an on-board processing system 113. The battery unit 112 is interchangeable from a rechargeable lithium-ion battery for low-temperature wells (<60° C.) and a non-rechargeable battery for high-temperature wells (<120° C.). The autonomous unit is shown positioned within a bore hole 10.

In some cases, it may be necessary to enhance the battery unit with further means for generating power. Though for many cases, it may suffice to provide an "umbilical cord" between a wireline unit and the autonomous unit, a preferred embodiment of the invention envisages power generation means as part of the autonomous unit. Preferably the additional power generation system extracts energy from surrounding fluid flow through the bore hole. Such a system may include a turbine which is either positioned into the fluid flow on demand, i.e, when the battery unit is exhausted, or is permanently exposed to the flow.

The on-board processing system or logic unit includes a multiprocessor (e.g., a Motorola 680X0 processor) that controls via a bus system 114 with I/O control circuits and a high-current driver for the locomotion unit and other servo processes, actuators, and sensors. Also part of the on-board processing is a flash memory type data storage to store data acquired during one exploration cycle of the autonomous unit. Data storage could be alternatively provided by miniature hard disks, which are commercially available with a diameter of below 4 cm, or conventional DRAM, SRAM or (E) EPROM storage. All electronic equipment is selected to be functional in a temperature range of up to 120° C. and higher. For high-temperature wells it is contemplated to use a Dewar capsule to enclose temperature-sensitive elements such as battery or electronic devices.

The locomotion unit consists of a caterpillar rear section 12 and a wheel front section 13. As shown in FIG. 1B, the three caterpillar tracks 12-1, 12-2, 12-3 are arranged along the is outer circumference of the main body separated by 120°. The arrangement of the three wheels 13-1, 13-2, 13-3 some of which is shown in FIG. 1A is phase-shifted by 60° with respect to the caterpillar tracks. The direction of the motion is reversed by reversing the rotation of the caterpillar tracks. Steering and motion control are largely simplified by the essentially one-dimensional nature of the path. To accommodate for the unevenness of the bore hole, the caterpillar tracks and the wheels are suspended.

The locomotion unit can be replaced by a fully wheeled variant or a full caterpillar traction. Other possibilities include legged locomotion units as known in the art.

The caterpillar tracks or the other locomotion means contemplated herein are characterized by having a confined area of contact with wall of the wellbore. Hence, during the motion phase an essentially annular region is left between the outer hull of the autonomous unit and the wall of the wellbore for the passage of well fluids.

Also part of the main body of the autonomous unit is a acoustic sensor system 14 (shown in FIG. 1A) which emits and receives ultrasonic energy. During operation, the acoustic sensor system 14 is used to identify specific features of the surrounding formation—e.g., perforations in the casing of the well.

The autonomous vehicle further comprises a bay section 15 for mounting mission specific equipment such as a flowmeter or a resistivity meter. In a preferred embodiment, the mission specific equipment is designed with a common interface to the processing system 113 of the autonomous unit. It should be appreciated that the mission specific equipment may include any known logging tools, tools for remedial operation, and the like, provided that the geometry of the equipment and its control system can be adapted to the available bay section. For most cases, this adaptation of known tools is believed to be well within the scope of an ordinarily skilled person.

Figure 2:
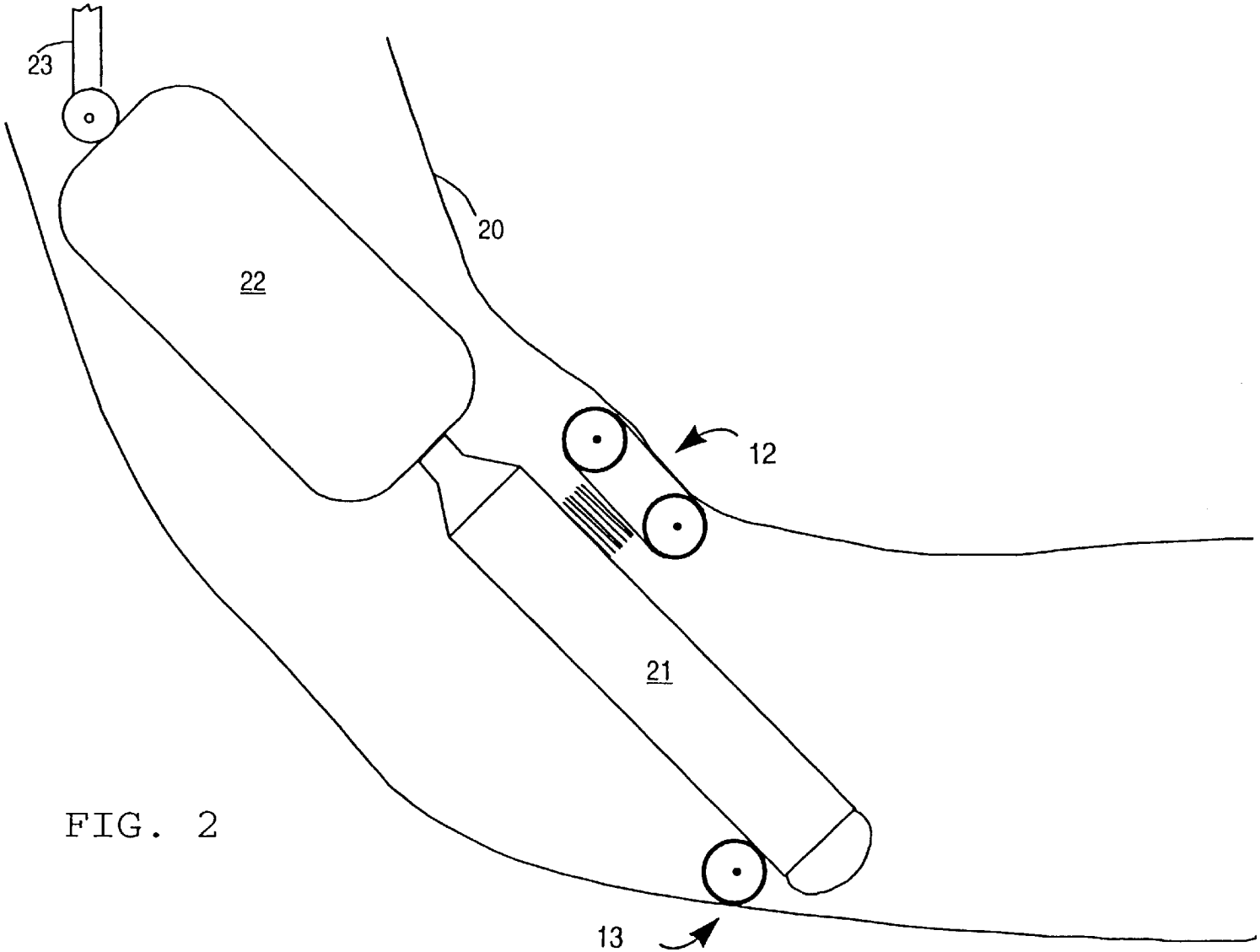
FIG. 2 illustrates the deployment of a down hole tool with an autonomous unit.

Referring now to FIG. 2, an autonomous unit or robot 21, as described above, is shown attached to a wireline unit 22 lowered by gravity into a wellbore 20. The wireline unit is connected via a wire 23 to the surface. Following conventional methods, the wire 23 is used to transmit data, signals and/or energy to and from the wireline unit 22.

The combined wireline unit 22 and autonomous unit or robot 21, as shown in FIG. 2 can be deployed in an existing well on a wireline cable either to the bottom of the production tubing or as deep into the well as gravity will carry it. Alternatively, for a new well, the combined unit can be installed with the completion. In both cases the wireline unit 22 remains connected to the surface by a wireline cable capable of carrying data and power. In operation, the autonomous unit or robot 21 can detach from the wireline unit 22 using a connector unit described below in greater detail.

The robot can recharge its power supply while in contact with the wireline unit 22. It can also receive instructions from the surface via the wireline unit 22, and it can transmit data from its memory to the surface via the wireline unit 22. To conduct logging operations, the robot detaches from the "mother ship" and proceeds under its own power along the well, For a cased well the autonomous unit or robot 21 merely has to negotiate a path along a steel lined pipe which may have some debris on the low side. Whereas the independent locomotion unit of the autonomous unit or robot 21 is described hereinbefore, it is envisaged to facilitate the return of the autonomous unit or robot 21 to the wireline unit 22 by one or a combination of a spoolable "umbilical cord" or a foldable parachute which carries or assists the robot on its way back.

In many production logging applications, the casing is perforated at intervals along the well to allow fluid flow from the reservoir into the well. The location of these perforations (which have entrance diameters of around ½") is sensed by the autonomous unit or robot 21 using either its acoustic system or additional systems, which are preferably mounted part of its pay-load, such as an optical fiber flowmeter or local resistivity measuring tools.

After having performed the logging operation, the measured data is collected in the memory of the autonomous unit or robot 21, and is indexed by the location of the perforation cluster (in terms of the sequence of clusters from the wireline unit 22. The autonomous unit or robot 21 can then move on to another cluster of perforations. The robot's ability to position itself locally with reference to the perforations will also allow exotic measurements at the perforation level and repair of poorly performing perforations such as plugging off a perforation or cleaning the perforation by pumping fluid into the perforation tunnel. After certain periods, the length of which is mainly dictated by the available power source, the autonomous unit or robot 21 returns to the wireline unit 22 for data and/or energy transfer.

It may be considered useful to provide the autonomous unit or robot 21 with a telemetry channel to the wireline unit 22 or directly to the surface. Such a channel can again be set up by an "umbilical cord" connection, (e.g., a glass fiber), or by a mud pulse system similar to the ones known in the field of Measurement-While-Drilling (MWD). Within steel casings, basic telemetry can be achieved by means for transferring acoustic energy to the casing, e.g., an electromagnetically driven pin, attached to or included in the main body of the autonomous unit or robot 21.

Complex down hole operations may accommodate several robots associated with one or more wireline units at different locations in the wellbore.

Figure 3:
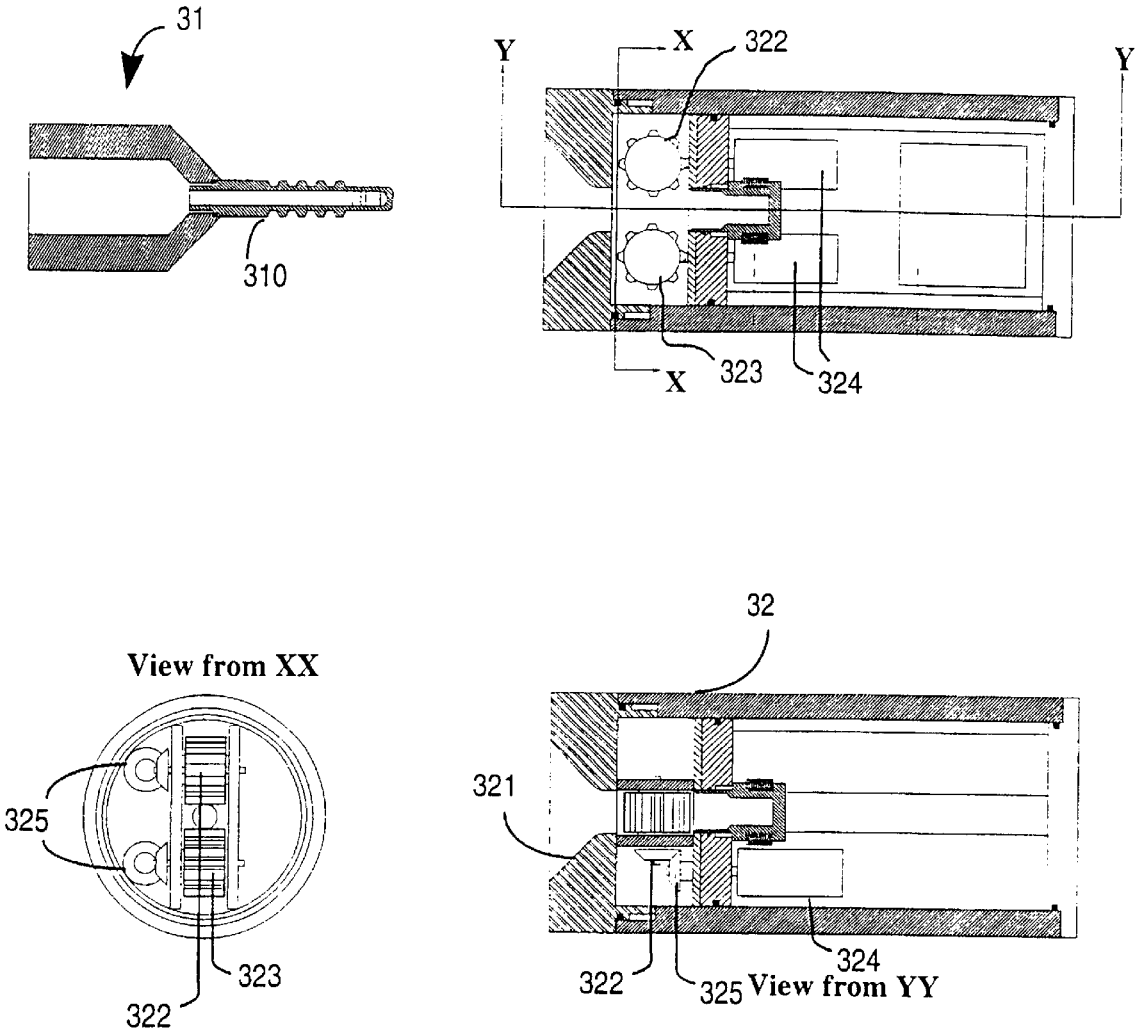
FIGS. 3, 4 depict and illustrate details of a coupling unit within a down hole tool in accordance with the present invention.
Figure 4:
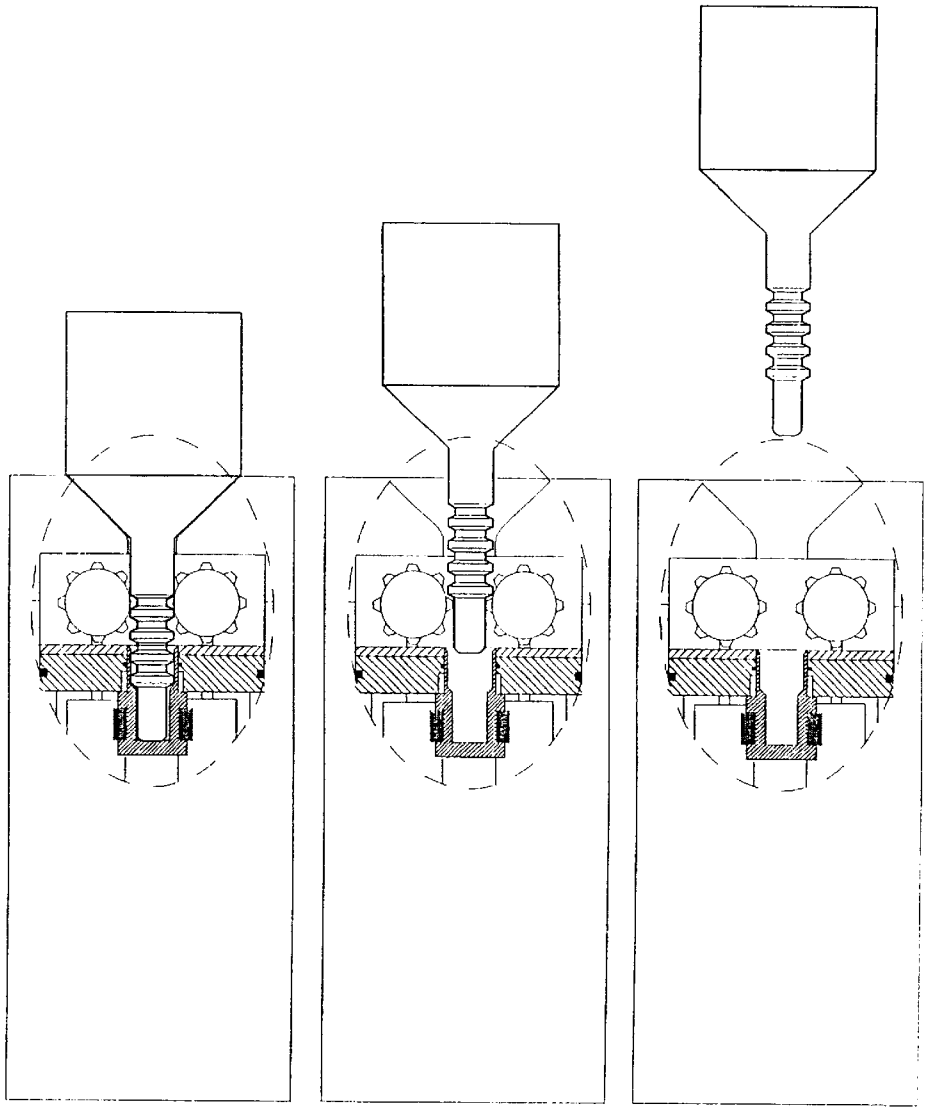

An important aspect of the example is the connection system between the wireline unit 22 and the autonomous unit or robot 21, illustrated by FIGS. 3 and 4. A suitable connection system has to provide a secure mechanical and/or electrical connection in a "wet" environment, as usually both units are immersed in an oil-water emulsion.

An example of a suitable connection mechanism is shown in FIG. 3. An autonomous unit 31 is equipped with a probe 310 the external surface of which is a circular rack gear which engages with a wireline unit 32. Both the wireline unit 32 and a autonomous unit 31 can be centralized or otherwise aligned. As the autonomous unit 31 drives towards the wireline unit 32, the probe 310 engages in a guide 321 at the base of the wireline unit 32 as shown. As the probe 310 progressively engages with the wireline unit 32, it will cause the upper pinion 322 to rotate. This rotation is sensed by a suitable sensor and the lower pinion 323 (or both pinions), is in response to a control signal, actively driven by a motor 324 and beveled drive gears 325 so as to pull the robot probe into the fully engaged position as shown in the sequence of FIG. 4. A latch mechanism then prevents further rotation of the drive pinions and locks the autonomous unit 31 to the wireline unit. In the fully engaged position, the two sections of an inductive coupling are aligned. Data and power can now be transmitted down the wireline, via the wireline unit 32 to the autonomous unit 31 across the inductive link. For higher power requirements a direct electrical contact can be made in a similar fashion.

Figure 5A:
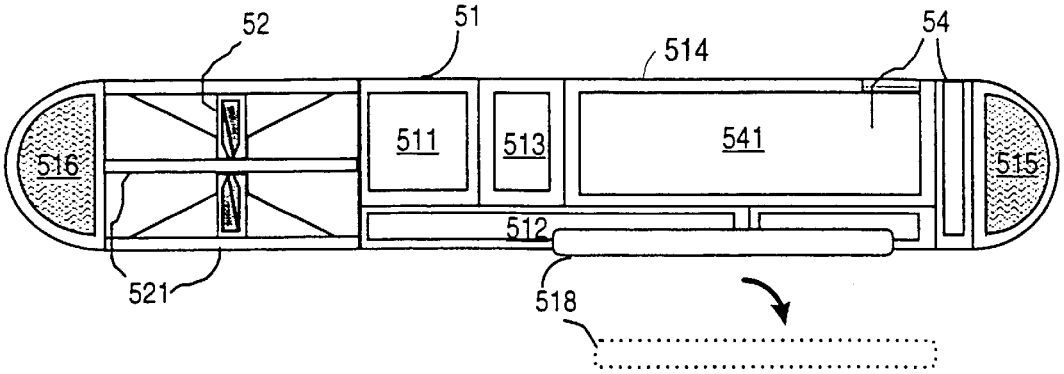
FIGS. 5A, B show (schematic) cross-sections of an autonomous unit of a down hole tool in accordance with the invention.
Figure 5B:
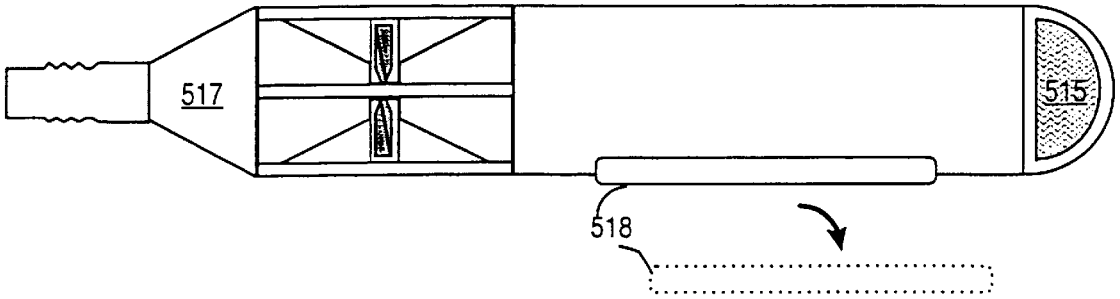

Referring now to FIGS. 5A and 5B, a further variant of the invention is illustrated.

The locomotion unit of the variant comprises a propeller unit 52, surrounded and protected by four support rods 521. The propeller unit 52 either moves in a "U-Boat" style or in a sliding fashion in contact with, for example, the bottom of a horizontal well. In both modes, an essentially annular region, though off-centered in the latter case, is left between the outer hull of the autonomous unit and the wellbore.

Further components of the autonomous unit comprise a motor and gear box 511, a battery unit 512, a central processing unit 513, and sensor units 54, including a temperature sensor, a pressure sensor, an inclinometer and a video camera unit 541. The digital video is modified from its commercially available version (JVC GRDY1) to fit into the unit. The lighting for the camera is provided by four LEDs. Details of the processing unit are described below in connection with FIG. 6.

The main body 51 of the autonomous unit has a positive buoyancy in an oil-water environment. The positive buoyancy is achieved by encapsulating the major components in a pressure-tight cell 514 filled with gas, (e.g., air or nitrogen). In addition, the buoyancy can be tuned using two chambers 515, 516, located at the front and the rear end of the autonomous unit.

FIGS. 5A, B illustrate two variants of the invention, one of which (FIG. 5A) is designed to be launched from the surface. The second variant(FIG. 5B) can be lowered into the wellbore while being attached to a wireline unit. To enable multiple docking maneuvers, the rear buoyancy tank 517 of the latter example is shaped as a probe to connect to a wireline unit in the same way as described above.

During the descent through the vertical section of the borehole, the positive buoyancy is balanced by a ballast section 518. The ballast section 518 is designed to give the unit a neutral buoyancy. As the ballast section is released in the well, care has to be taken to select a ballast material which dissolves under down hole conditions. Suitable materials could include rock salt or fine grain lead shot glued together with a dissolvable glue.

Figure 6:
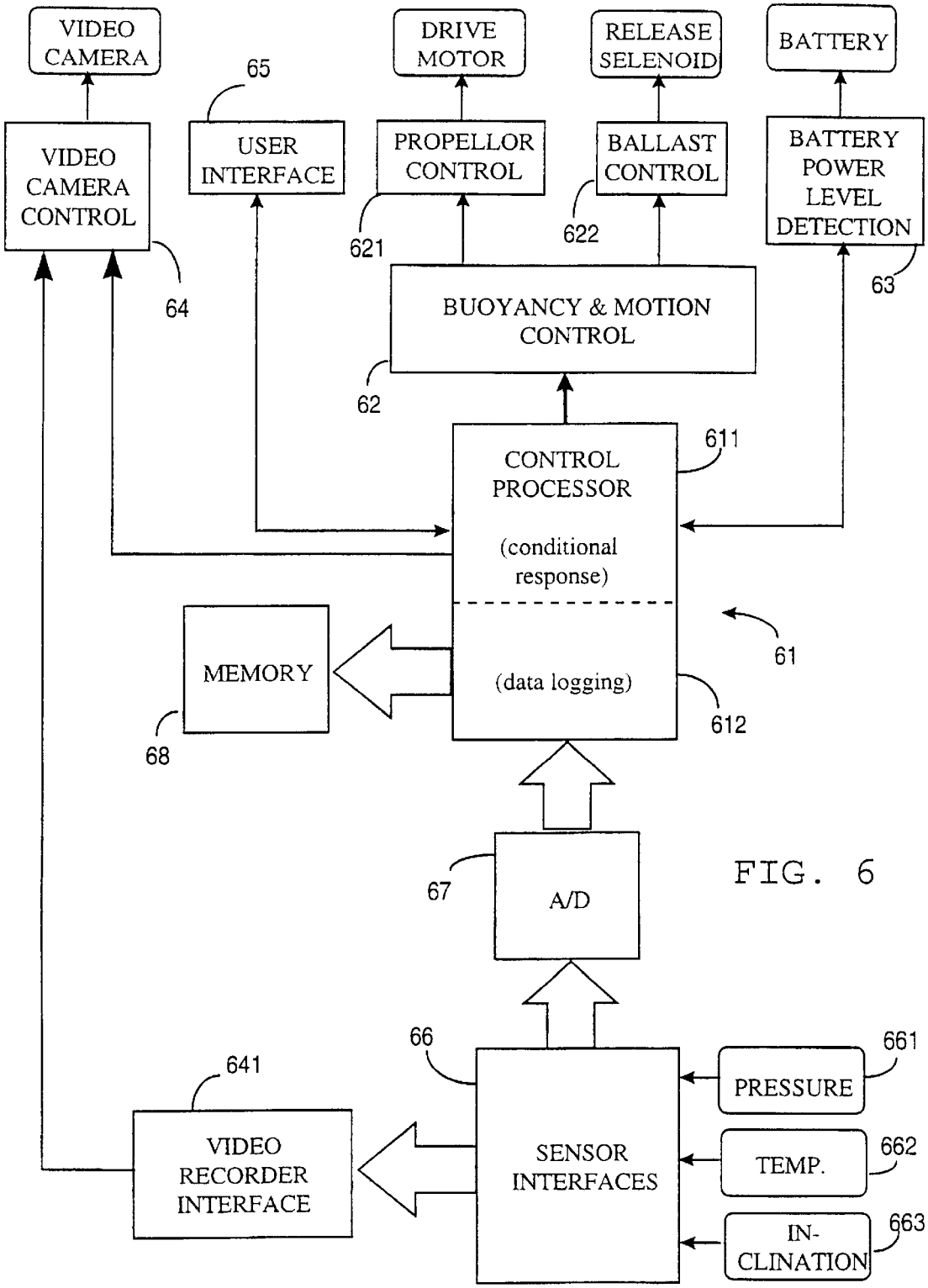
FIG. 6 illustrates major electronic circuitry components of the example of FIG. 5.

With reference to FIG. 6, further details of the control circuit system 513 are described.

A central control processor 61 based on a RISC processor (PIC 16C74A) is divided logically into a conditional response section 611 and a data logging section 612. The conditioned response section 611 is programmed so as to control the motion of the autonomous unit via a buoyancy and motion control unit 62. Specific control units 621, 622 are provided for the drive motor and the release solenoids for the ballast section, respectively. Further control connections are provided for the battery power level detection unit 63 connected to the battery unit and the video camera control unit 64 dedicated to the operation of a video camera. The conditional response section 611 can be programmed through a user interface 65.

The flow and storage of measured data is mainly controlled by the data logging section 612. The sensor interface unit 661 (including a pressure sensor 661, a temperature sensor 662, and an inclinometer 663) transmits data via A/D converter unit 67 to the data logging section 612 which stores the data in an EEPROM type memory 68 for later retrieval. In addition, sensor data are stored on the video tape of the video camera via a video recorder interface 641.

An operation cycle starts with releasing the autonomous unit from the wellhead or from a wireline unit. Then, the locomotion unit is activated. As the horizontal part of the well is reached, the pressure sensor 661 indicate an essentially constant pressure. During this stage the unit can move back and forth following instructions stored in the control processor 61. The ballast remains attached to the autonomous unit during this period. On return to the vertical section of the well, as indicated by the inclinometer 663 , the ballast 518 is released to create a positive buoyancy of the autonomous unit. The positive buoyancy can be supported by the propeller unit 52 operating at a reverse thrust.

The return programme is activated after (a) a predefined time period or (b) after completing the measurements or (c) when the power level of the battery unit indicates insufficient power for the return trip. The conditionel response section 611 executes the instructions according to a decision tree programmed such that the return voyage takes priority over the measurement programme. The example given illustrates just one set of the programmed instructions which afford the down hole tool full autonomy. Other instructions are, for example, designed to prevent a release of the ballast section in the horizontal part of the wellbore. Other options may include a docking programme enabling the autonomous unit to carry out multiple attempts to engage with the wireline unit. The autonomous unit is thus designed to operate independently and without requiring intervention from the surface under normal operating conditions. However, it is feasible to alter the instructions through the wireline unit during the period(s) in which the autonomous unit is attached or through direct signal transmission from the surface.

It will be appreciated that the apparatus and methods described herein can be advantageously used to provide logging and remedial operation in horizontal or high-angle wells without a forced movement, (e.g., by coiled tubing), from the surface.

What is claimed is:

1. A method for acquiring signals representing down hole conditions of a wellbore in a hydrocarbon reservoir, said method including the steps of:

(a) introducing an autonomous unit into the wellbore, said autonomous unit being adapted to operate untethered in the wellbore untethered from the surface and comprising:

(i) a locomotion unit for providing motion along the wellbore;

(ii) detecting units for detecting the down hole conditions; and (iii) a logic unit for controlling said autonomous unit, said logic unit being capable of making decisions based on at least two input parameters; and (b) activating said locomotion unit and said detecting units so as to perform measurements of the down hole conditions in at least one location of the wellbore while the autonomous unit is untethered from the surface.

2. The method of claim 1, wherein the introducing step comprises lowering said autonomous unit into the wellbore while separably and re-connectably attached to a wireline unit.

3. The method of claim 1 and further comprising the step of moving said autonomous unit through a horizontal or high-angle wellbore.

4. A down hole tool for detecting down hole conditions in a wellbore in a hydrocarbon reservoir, said down hole tool comprising:

(a) an autonomous unit comprising a locomotion unit for providing a motion along the wellbore, said autonomous unit being adapted for operation in the wellbore untethered from the surface;

(b) detecting units for detecting said down hole conditions; and (c) a logic unit for controlling said autonomous unit, said logic unit being capable of making decisions based on at least two input parameters.

5. The down hole tool of claim 4 and further comprising a wireline unit connected to the surface and a connection system for providing a separable and re connectable connection between said wireline unit and said autonomous unit.

6. The down hole tool of claim 5, wherein said autonomous unit comprises a power generating system inside the wellbore.

7. The down hole tool of claim 4, wherein said locomotion unit is selected form a group comprising caterpillar tracks, propeller, wheels or a combination thereof.

8. The down hole tool of claim 4, wherein said autonomous unit further comprises a video unit for collecting images from the wellbore.

9. A down hole tool for detecting down hole conditions in a wellbore in a hydrocarbon reservoir, said down hole tool comprising:

(a) an autonomous unit having a locomotion unit for providing a notion along the wellbore;

(b) detecting units for detecting said down hole conditions;

(c) a logic unit for controlling said autonomous unit, said logic unit being capable of making decisions based on at least two input parameters; and (d) a wireline unit connected to the surface and a connection system for providing a separable and re-connectable connection between said wireline unit and said autonomous unit, wherein said connection system includes a motor unit for closing and/or breaking the connection.

10. A connection system for providing a separable and reconnectable connection between an autonomous unit comprising a logic unit and a wireline unit of a down hole tool in a wellbore for hydrocarbon exploration or production, said connection, when closed, providing for the transmission of data down the wireline unit and across the connection to the logic unit of the autonomous unit said connection system comprising:

a motor unit for closing and/or breaking the connection.

11. A connection system according to claim 10, wherein said connection, when closed, provides for the transmission of power down the wireline unit and across the connection to the autonomous unit.

12. A connection system according to claim 10, wherein said connection, when closed, provides an inductive link between the wireline unit and the autonomous unit.

13. A connection system according to claim 10, wherein said connection, when closed, provides direct electrical connection between the wireline unit and the autonomous unit.

14. A connection system according to claim 10, wherein:

(a) the autonomous unit comprises a probe;

(b) the wireless unit comprises pinions on the wireline unit; and (c) said motor unit drives the pinions to pull the probe into the wireline unit, thereby closing said connection.

15. The connection system according to claim 10, and further comprising a latch mechanism to lock the autonomous unit to the wireline unit.

16. An autonomous downhole oilfield tool comprising;

a) a body adapted to be delivered into a wellbore from the surface and be resident in the wellbore, the body being adapted to operate untethered from the surface;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving the body within the wellbore; and g) an end work device associated with the body performing a desired function downhole.

17. A downhole tool as set forth in claim 16 further comprising a transmitter associated with the body transmitting data to a receiver associated with other equipment operatively associated with the wellbore.

18. A downhole tool as set forth in claim 17, wherein the other equipment is selected from the group comprising a surface controller, a transceiver, down hole mechanical equipment, and down hole sensors.

19. A downhole tool as set forth in claim 16 further comprising a receiver associated with the body receiving data from a transmitter associated with other equipment operatively associated with the wellbore.

20. A downhole tool as set forth in claim 19, wherein the other equipment is selected from the group comprising a surface controller, a transceiver, downhole mechanical equipment, downhole sensors and a docking station.

21. A downhole tool as claimed in claim 16 wherein said end use device comprises at least one carrier detachably securing and transporting downhole equipment from a first location in the wellbore to a second location.

22. A downhole work system comprising;

a) at least one of the autonomous downhole tool as claimed in claim 21;

b) at least one wireline unit in the wellbore having the ability to communicate with the autonomous tool and having access to equipment deliverable to said autonomous tool to facilitate said autonomous tool in carrying out a desired operation.

23. A down hole tool as claimed in claim 16 wherein said end work device comprises at least one sensor monitoring data in the wellbore, said sensor being selected from the group consisting of formation sensors, wellbore production fluid parameter sensors, and wellbore equipment sensors.

24. A downhole tool as claimed in claim 23 wherein said at least one sensor is an imaging system.

25. A down hole tool as set forth in claim 16 wherein the body and the end work device together form an item of down hole equipment and operate with the wellbore structure to perform the desired function.

26. A downhole tool as claimed in claim 16 wherein said power source is self contained in association with said body of said tool.

27. A downhole tool as claimed in claim 16 wherein said transport mechanism utilizes mechanical propagation.

28. A downhole tool as claimed in claim 16 wherein said transport mechanism utilizes fluid propagation.

29. A down hole work system comprising:

a plurality of the down hole tools as claimed in claim 16 and a communications system communicating with a plurality of other said down hole tools to accomplish a desired function.

30. A downhole tool as claimed in claim 16 wherein said body is adapted to operate electrically tethered to a remote point in the wellbore.

31. A downhole work system comprising:

a delivery system delivering an autonomous downhole oilfield tool to a predetermined location downhole and releasing the downhole tool at said predetermined location, the downhole comprising:

a) a body adapted to be delivered into a wellbore from the surface and be resident in the wellbore;

b) a source of electrical power operatively associated with the body;

c) at least one sensor associated with the body monitoring at least one operating parameter of the tool relative to its environment;

d) a microprocessor associated with the body receiving data from the sensor;

e) memory associated with the microprocessor providing information for operating instructions to the body;

f) transport mechanism controlled by the microprocessor and moving the body within the wellbore; and g) an end work device associated with the body performing a desired function downhole.

32. A wellbore monitoring control and work system comprising:

(a) a wellbore (b) a body adapted to be delivered into a wellbore from the surface and be resident in the wellbore;

(c) a source of electrical power operatively associated with the body;

(d) at least one sensor associated with the body monitoring at least one operating parameter of the tool relative to its environment;

(e) a microprocessor associated with the body receiving data from the sensor;

(f) memory associated with the microprocessor providing information for operating instructions to the body;

(g) transport mechanism controlled by the microprocessor and moving the body within the wellbore;

(h) an end work device associated with the body performing a desired function down hole;

(i) a wireline unit located in the wellbore at a predetermined location, said wireline unit cooperating with said body to provide electrical power and data to the body, and said body being adapted to operate untethered from said wireline unit.

33. A wellbore monitoring control and work system as claimed in claim 32 wherein said body is further adapted to operate tethered to the wireline unit.

34. A down hole tool for detecting down hole conditions in a wellbore in a hydrocarbon reservoir, said tool comprising;

(a) an autonomous unit having an outer hull and a locomotion unit for providing motion along the wellbore, said autonomous unit being designed such that, during motion, an essentially annular region is left between said outer hull of said autonomous unit and the wall of the wellbore;

(b) detecting units for detecting the down hole conditions; and (c) a logic unit for controlling said autonomous unit, said logic unit being capable of making decisions based on at least two input parameters, the tool being adapted to operate in the wellbore untethered from the surface.

35. A down hole tool for detecting downhole conditions in a wellbore in a hydrocarbon reservoir, said downhole tool comprising:

(a) an autonomous unit having a locomotion unit for providing motion along the wellbore;

(b) detecting units for detecting the down hole conditions; and (c) a logic unit for controlling said autonomous unit, said logic unit being capable of making decisions based on at least two input parameters, (d) wherein the buoyancy of said autonomous unit is controlled by a releasable ballast unit.

36. A downhole tool for detecting down hole conditions in a wellbore in a hydrocarbon reservoir, said downhole tool comprising:

(a) an autonomous unit having a locomotion unit for providing motion along the wellbore, said autonomous unit comprising a foldable parachute for supporting a motion in a direction of a flow in the wellbore;

(b) detecting units for detecting the down hole conditions; and (c) a logic unit for controlling said autonomous unit, said logic unit being capable of making decisions based on at least two input parameters, and said tool being adapted to operate in the wellbore untethered from the surface.

37. A down hole tool for detecting down hole conditions in a wellbore in a hydrocarbon reservoir, said downhole tool comprising:

(a) an autonomous unit having a locomotion unit for providing motion along the wellbore, said autonomous unit comprising a foldable parachute for supporting a motion in a direction of a flow in the wellbore;

(b) detecting units for detecting the down hole conditions; and (c) a logic unit for controlling said autonomous unit, said logic unit being capable of making decisions based on at least two input parameters, and said tool being adapted to operate in the wellbore untethered from the surface.

38. A down hole tool for detecting down hole conditions in a wellbore in a hydrocarbon reservoir, said down hole tool comprising:

(a) an autonomous unit:

(i) having a locomotion unit for providing motion along the wellbore and (ii) comprising a telemetry channel for communicating signals;

(b) detecting units for detecting the down hole conditions; and (c) a logic unit for controlling said autonomous unit, said logic unit being capable of making decisions based on at least two input parameters, and said tool being adapted to operate in the wellbore untethered from the surface.

39. The down hole tool of claim 38, wherein said telemetry channel includes a system for transferring acoustic energy to a surrounding liquid or casing.

* * * * *